US005437143A

United States Patent [19]

Culpepper et al.

[11] Patent Number: 5,437,143

[45] Date of Patent: Aug. 1, 1995

[54] METHOD OF FORMING A PACKAGE OF BEVERAGE CANS

[75] Inventors: Will L. Culpepper, Covington; James R. Oliff, Austell, both of Ga.

[73] Assignee: The Mead Corporation, Dayton, Ohio

[21] Appl. No.: 123,549

[22] Filed: Sep. 20, 1993

[51] Int. Cl.[6] ..... B65B 35/50; B65B 61/20; B65B 5/06

[52] U.S. Cl. ..... 53/445; 53/156; 53/157; 53/48.1; 53/447; 53/566

[58] Field of Search ..... 53/445, 447, 443, 458, 53/157, 156, 540, 48.1, 48.6, 566, 564, 238, 252, 251, 250, 263, 255; 206/430, 821

[56] References Cited

U.S. PATENT DOCUMENTS

| | | | |
|---|---|---|---|
| 2,556,188 | 6/1951 | Jakob | 53/157 |
| 3,224,575 | 12/1965 | Whiteford | 53/48.1 X |
| 3,242,631 | 3/1966 | Whiteford | 53/48.1 X |
| 3,351,264 | 11/1967 | Bostrom | 229/120.32 |
| 3,477,564 | 11/1969 | Crabtree | 206/432 |
| 4,043,097 | 8/1977 | Ishida et al. | 53/157 X |
| 4,739,884 | 4/1988 | Duplessy | 206/499 |
| 4,789,063 | 12/1988 | Hammett | 206/432 |
| 5,246,113 | 9/1993 | Schuster | 206/430 |
| 5,282,348 | 2/1994 | Dampier et al. | 53/48.1 X |

*Primary Examiner*—James F. Coan
*Attorney, Agent, or Firm*—Tsugihiko Suzuki

[57] ABSTRACT

In a method of forming a package of cylindrical beverage cans, a predetermined number of cans is arranged to define a first tier. An insert panel is placed onto the first tier, having formed therein a plurality of substantially circular debossments, each debossment having a diameter not greater than the can top diameter and not less than the can bottom diameter. The debossments are arranged so that one debossment is positioned concentrically on top of each can of the lower tier. Onto the insert panel is placed a second tier of cans by sliding movement of each can along the insert panel until the can is positioned with its bottom seated within one debossment. The first tier, insert panel and second tier are slid together as a unit into a carton through its open end.

7 Claims, 7 Drawing Sheets

METHOD OF FORMING A PACKAGE OF BEVERAGE CANS

BACKGROUND OF THE INVENTION

The present invention relates generally to cartons formed from paperboard material for packaging beverage containers such as cans, and more particularly to a method for forming such a carton for packaging the beverage cans in two or more tiers.

In modern beverage packaging, one of the most common forms of primary packaging is the drawn aluminum or steel can, most frequently holding twelve fluid ounces of beverage. Such cans include a generally cylindrical side wall with a lower end formed integrally with the side wall and connected to the side wall along a generally large radius of curvature to define a lowermost, generally circular base. The base is typically domed inwardly in its central portion for pressure resistance. An upper end is connected to the side wall, seamed thereto along a generally circular outer flange of a diameter greater than that of the base. The upper end includes a top surface recessed inwardly with respect to the uppermost portions of the flange.

It is common to market such beverage cans in secondary, paperboard packages containing a multiple of cans. Such cans are normally arranged in a single tier, with a common multiple being twelve cans, arranged in a 3×4 array. However, higher multiples such as 24 or more cans may also be packaged in a single carton. Especially at such higher multiples, the carton can become awkwardly large in certain dimensions, and the single-tier arrangement also leaves four of six carton sides of relatively short height for the printing of graphics.

One solution to this problem is to package multiples of cans in two or more tiers. For example, a carton of 24 cans can be arranged as two tiers of 3×4 arrays in vertical alignment. Such a carton has the convenient perimeter of a twelve-pack carton, but double-height graphic area on its sides.

A multiple-tier can carton is not without disadvantages, however. Modern, high-speed packaging equipment requires the loading of cartons through one or both ends of a paperboard sleeve. In many machines, this results in the sliding or conveying movement of cans as they are loaded into the carton. For multiple tiers, either the cans are moved in a stacked condition, or the cans of upper tiers must be moved over the cans of an already arranged lower tier. However, this is difficult as a result of the can construction described above, as the cans will "nest" with the base of an upper-tier can fitting within the flange of the top of a lower-tier can. This problem can be overcome by moving already-stacked cans within the packaging machine, but the can-to-can contact and relative motion between stacked cans resulting in such an approach may be objectionable.

A second solution to this problem may be had by placing a divider panel between tiers of cans so that no vertical can-to-can contact occurs. Such an approach is generally known, as discussed in U.S. Pat. No. 3,351,264. There, a formed thermoplastic divider is used. However, especially for waste disposal and recycling reasons, it is preferable that the divider be made from paperboard sheet. The disadvantage to this solution is that while the outer carton may at first be tightly wrapped about the stacked cans, over time the upper tier of cans will depress the paperboard divider panel into the recessed top panel of the lower tier of cans. This will in effect "shrink" the height of the carton contents, yielding a looser carton.

What is needed, therefore, is a solution to the problem of separating multiple tiers of cans while avoiding the disadvantages resulting from collapse of the paperboard divider panel over time into the recessed portions of the cans upon which the divider panel rests. Of course, any such solution must not unduly complicate the packaging operation or the overall carton design or function.

SUMMARY OF THE INVENTION

The present invention provides a method of forming a package of beverage cans, each of the cans having a can body defining a substantially circular bottom therefor having a bottom diameter, and a substantially circular can lid having a top diameter. The can bottom diameter is less than the can top diameter.

The method includes the steps of forming a predetermined number of the cans into a rectangular array to define a first tier of the cans. An insert panel is placed onto the first tier, the insert panel having an area generally equal to the cross-sectional area of the rectangular array. The panel has formed therein the same predetermined number of substantially circular debossments, each of the debossments having a debossment diameter not greater than the top diameter and not less than the bottom diameter. The debossments are arranged on the insert panel so that one of the debossments is positioned to extend downwardly toward and concentrically on top of each of the cans of the lower tier.

Onto the insert panel is placed a second tier of the predetermined number of the cans, the cans of the second tier being placed onto the insert panel by sliding movement of each of the cans along the insert panel until the can is positioned with the bottom seated within one of the debossments. As a result, the second tier is axially aligned with the first tier. The first tier of the cans, the insert panel and the second tier of the cans are then slid together as a unit into a carton having interconnected top, bottom and side walls, whereby the bottoms of the cans of the first tier are slid across the bottom wall of the carton into position.

The unit may be slid into position within the carton through an open end defined by the top, bottom and side walls. The carton may be further provided with a plurality of end flaps connected to at least some of the top, bottom and side walls at the open end, wherein the method comprises the further steps of folding the end flaps to close the open carton end, and securing the end flaps in folded position.

The cans of the second tier may be placed onto the insert panel by forming an incoming stream of cans, and directing the cans of the stream to the insert panel by at least one stationary guide member. The stream of the cans may be advanced toward the insert panel at least in part by a plurality of flight bars moving along a flight bar path, the flight bars contacting the cans to impart a pushing force thereto.

Each of the debossments may be formed into the insert panel by debossing into the insert panel a single, circular debossment sidewall disposed out of the plane of the insert panel. Alternatively, each of the debossments may be formed into the insert panel by debossing into the insert panel a plurality of circular, concentric debossment sidewalls disposed out of the plane of the insert panel.

DETAILED DESCRIPTION OF THE PREFERRED EMBODIMENT

Figure 1:
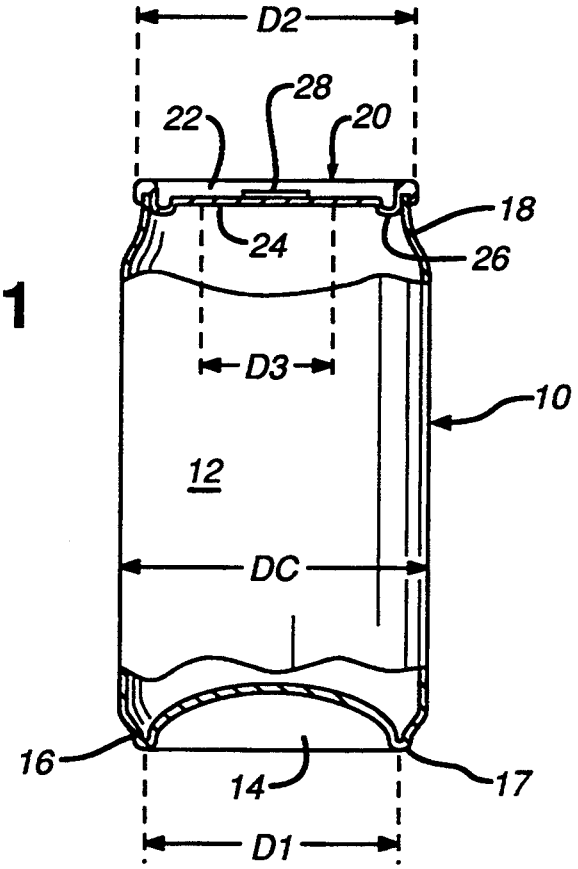
FIG. 1 is an elevational, partially sectional view of a typical beverage can as used with the present invention.

The present invention is intended primarily for use with drawn aluminum or steel cans of the type used in packaging beverages. A typical example of such a can is shown in FIG. 1, wherein can 10 includes a generally cylindrical side wall 12. Formed integrally with the side wall is a lower end 14 having a portion 16 connecting with side wall 12 which is of a relatively large radius of curvature and a lower circular base 17. The central portion of the lower end 14 of can 10 is domed inwardly.

At the upper end of side wall 12 is a necked-in portion 18, to which is attached the upper can end 20, seamed onto the can side wall along a flange 22. The can end includes a top surface 24 which is recessed below flange 22 and a further recessed countersink 26 may be positioned between surface 24 and flange 22 for added strength. A conventional opening means 28, such as an attached pull-tab, is provided in the central portion of surface 24.

The circular base 17 at the lowermost portion of lower end 14 of the can has a diameter D1. Flange 22 at the upper end 20 of the can is of a diameter D2 which is greater than the base diameter D1 (although less than the overall can diameter DC). Thus, when stacked, the can base 17 will nest within the upper end of the underlying can so that either the base rests on top surface 24 or the curved connecting portion 16 rests against the inner surface of flange 22.

Figure 2:
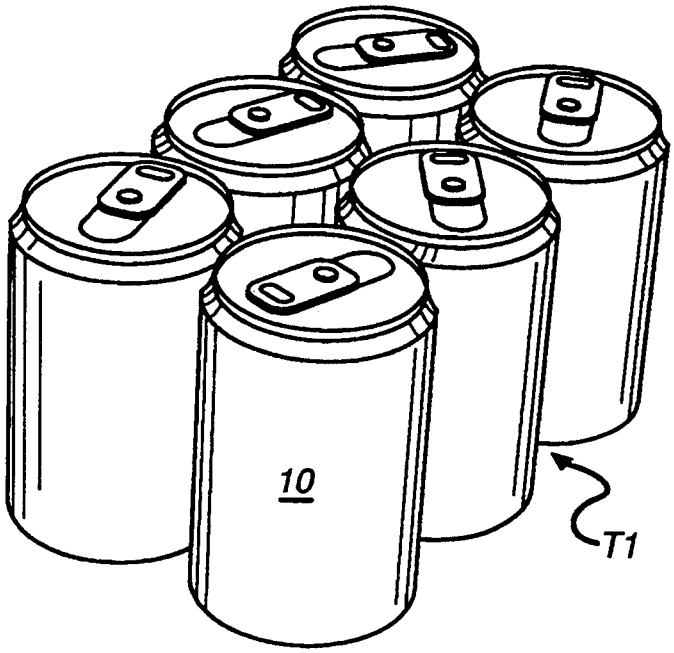
FIG. 2 is a perspective view of a plurality of cans arranged to form a first tier of cans, in accordance with a first step of the method of the present invention.

The initial step of the method of forming a package for beverage cans can be seen by reference to FIG. 2. A number of cans 10, comprising half the total number desired for the completed package, are arranged into a rectangular array to define a first tier T1. In the example shown herein, the cans are disposed into a 2×3 array for six cans total. Of course, it will be easily recognized that the present invention may be used with any number and/or arrangement of cans for each tier.

Figure 3:
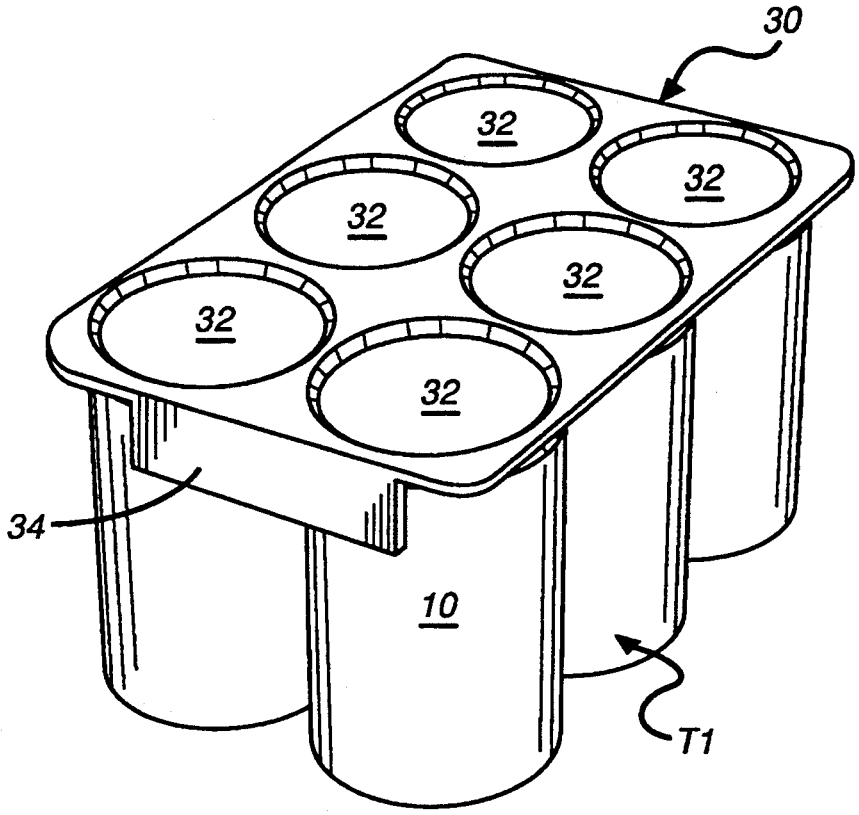
FIG. 3 is a view similar to FIG. 2 showing an insert panel in place in accordance with a further step of the method.

In order to eliminate metal-to-metal contact between the tops and bottoms of stacked cans in the completed package, and referring to FIG. 3, a divider panel 30 is placed onto the top surfaces of the cans 10 of the lower tier T1. Preferably, the surface area of panel 30 is approximately equal to the cross-sectional area of a horizontal section of the tier of cans. As can be seen, divider panel 30 includes a plurality of debossments 32, one such debossment for each of the cans in the lower tier T1. Each debossment 32 fits within the flange 22 of the upper can end 20, thereby facilitating the location of divider panel 30 on the top of the cans of the tier T1.

Figure 4:
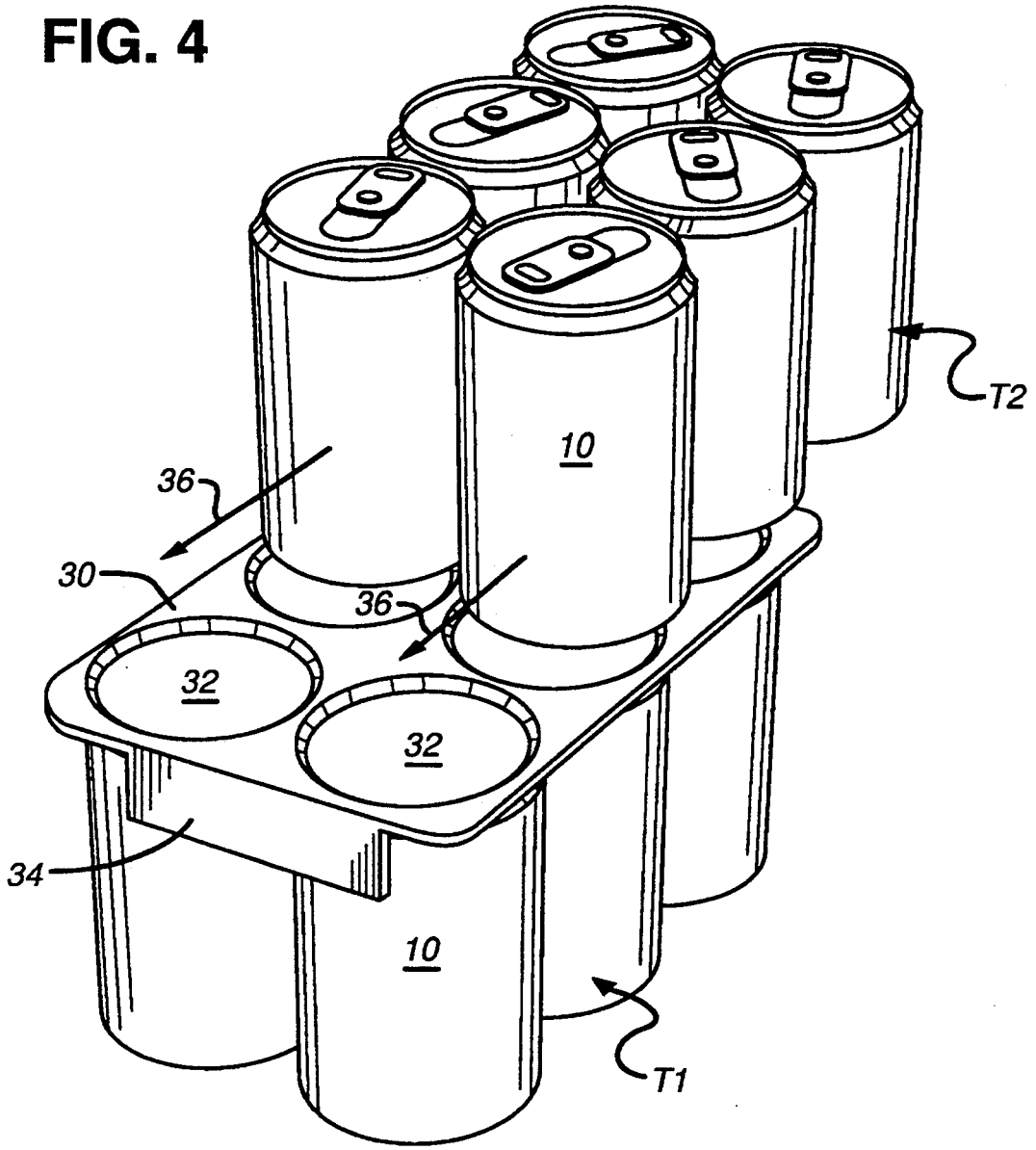
FIG. 4 is a view similar to FIG. 3 showing a second tier of cans being placed onto the insert panel in accordance with the method.

Referring now to FIG. 4, an identical number of cans 10 to form a second tier T2 are placed onto the insert panel 30. These cans are positioned on the insert panel by a sliding movement along the panel as indicated generally by the arrows 36. Such cans are slid until each can is positioned with its lower end 14 seated within one of the debossments 32. As a result, each can 10 of the second tier T2 is axially aligned with its corresponding can from the first tier T1. The unseen end flap 34 at the rear of insert panel 30 as shown in FIG. 4 retains the insert panel in position on the first tier T1 of cans, so that it is not displaced by the sliding motion of the cans of the second tier T2.

Figure 5:
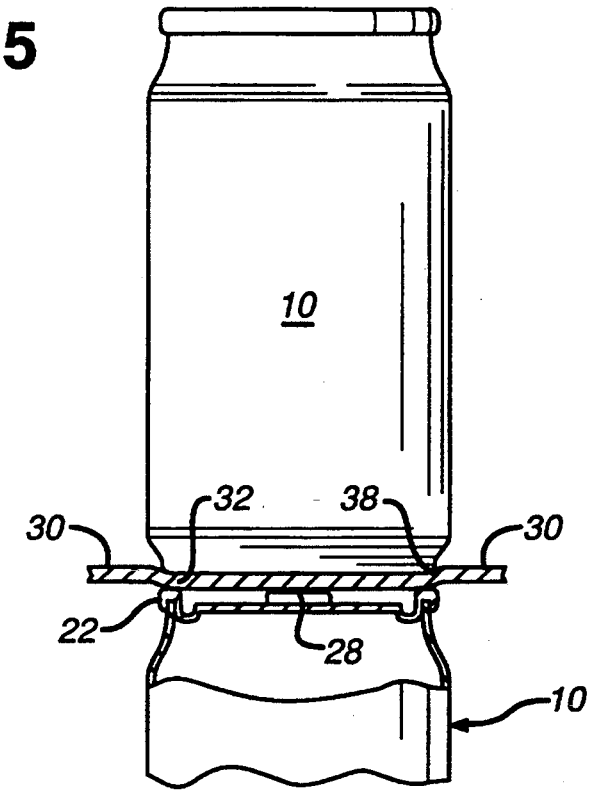
FIG. 5 is a sectional view showing the positioning of the insert panel between a stacked pair of cans.

The divider panel 30 may be seen in partial section, positioned between a pair of stacked cans by reference to FIG. 5. The debossment 32 is defined by a circular sidewall portion 38 which is approximately the diameter of the flange 22 of the can top and the bottom-most portion of the can 10 of the second, upper tier T2. As a result, the divider panel 30 is nested between the stacked pair of cans, with paperboard material extending completely between the adjacent lower and upper can surfaces, thereby preventing contact. In addition, the preformed debossment 32 eliminates the downward compression of a solid, non-embossed divider panel under influence of the weight of the upper can, which would result in a disadvantageous "shrinking" of the height of a completed can arrangement.

An additional advantage is achieved using the debossed divider panel in that the debossments 32 increase the rigidity or stiffness of the panel 30. This not only makes the panel easier to handle in automatic feeding and placing machinery, but also helps maintain the panel in rigid condition during the sliding of the upper tier cans into position.

Each debossment 32 is formed by conventional debossing techniques whereby the sidewall 38 is displaced downwardly out of the plane of the insert panel 30. The debossing may take place prior or subsequent to, or preferably during, the manufacture of the insert panel. As an example, the debossing may be performed during a die cutting operation to form panel 30 using a conventional press die machine.

Also, while as shown herein, each debossment 32 is defined by a single, circular sidewall 38, it would be possible to form each debossment as a plurality of concentric sidewalls. This may be advantageous especially if the particular cans to be packaged require a deep debossment, or if the paperboard material from which panel 30 is formed is thin or cannot otherwise have a relatively deep debossment formed without tearing.

Figure 6:
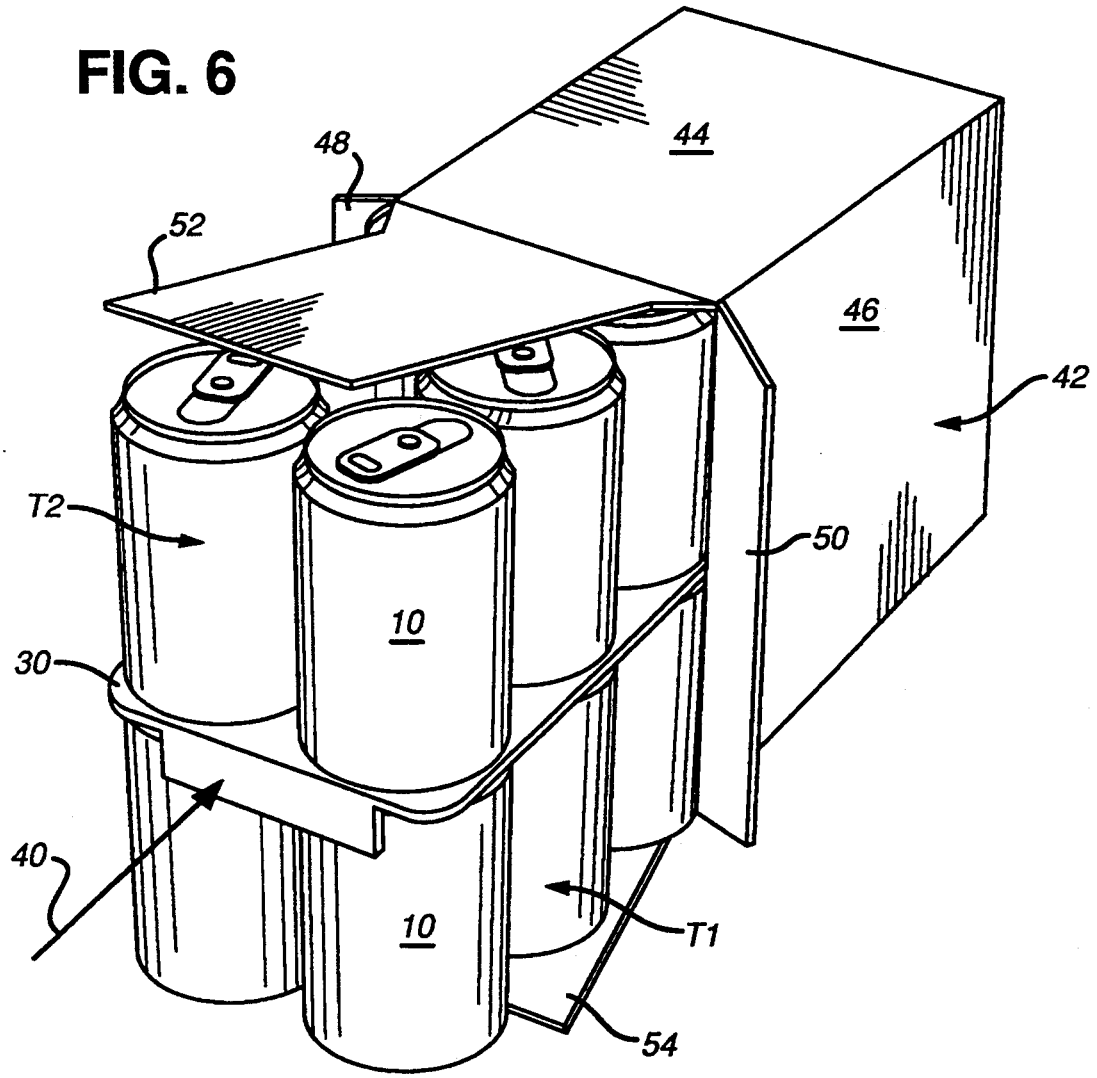
FIG. 6 is a view similar to FIG. 4 showing the assembled group of cans being placed into a carton in accordance with the method.

Referring now to FIG. 6, the cans and divider panel 30 are next moved as shown by arrow 40 into the interior of a sleeve-type carton 42, which may be an otherwise conventional carton used in the packaging of beverage cans. Carton 42 includes a top wall 44 and connected side wall 46. Not shown in FIG. 6 are an opposing side wall and bottom wall, all walls being interconnected to form the tubular sleeve. An end closure structure is provided by minor flaps 48 and 50, and major flaps 52 and 54.

Figure 7:
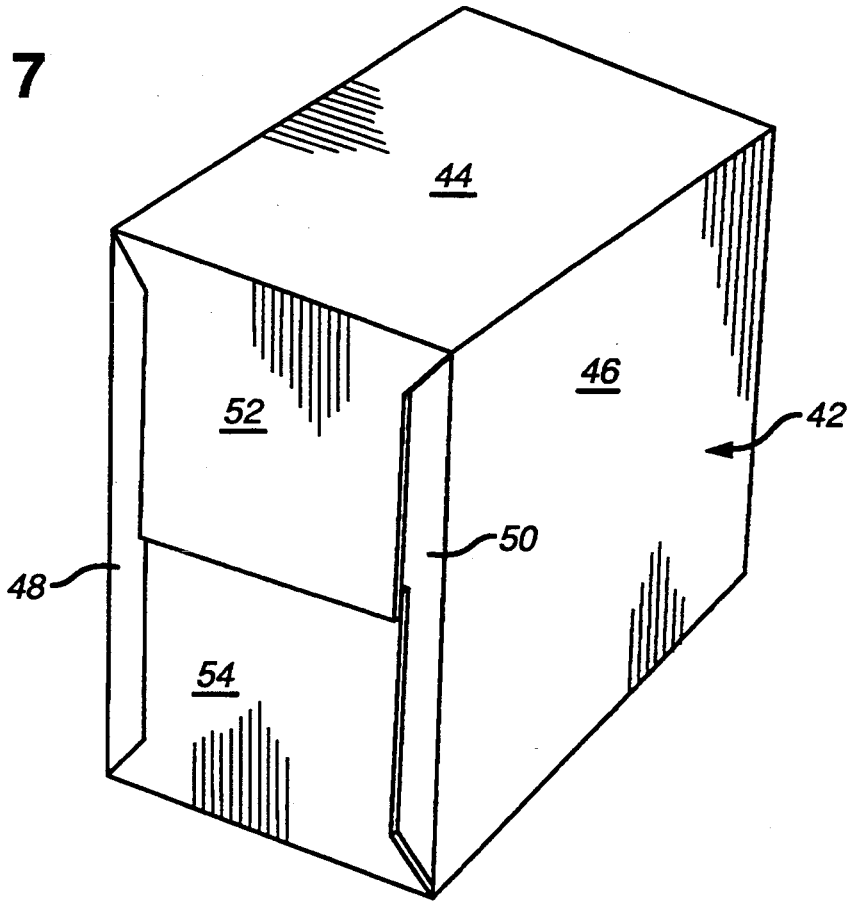
FIG. 7 is a view similar to FIG. 6 showing the completed and loaded carton.

Once the can arrangement is located entirely within carton 42, the closure structure is folded and sealed. Initially, flaps 48 and 50 are folded inwardly into position. Glue is then applied along flaps 48 and 50 and, optionally, to the flap 34 on divider panel 30. Major end flaps 54 and 52 are then folded into position and sealed by the applied glue. The completed carton is shown in FIG. 7.

It will be recognized that many variations may be used within the carton described above. For example, as an alternate to the square corners shown in the disclosed carton, a carton having bevel corners such as that described in U.S. Pat. No. 4,216,861 may be used. In addition, the carton design may be enhanced through the use of handles, opening means and the like, using structures known and understood within the art.

It should be further recognized that it would be possible to replace the single divider panel 30 with two or more divider panels, each being positioned between portions of the stacked can arrangement. In such a case, the cans could additionally be loaded into the carton from both of its opposing ends.

Figure 8:
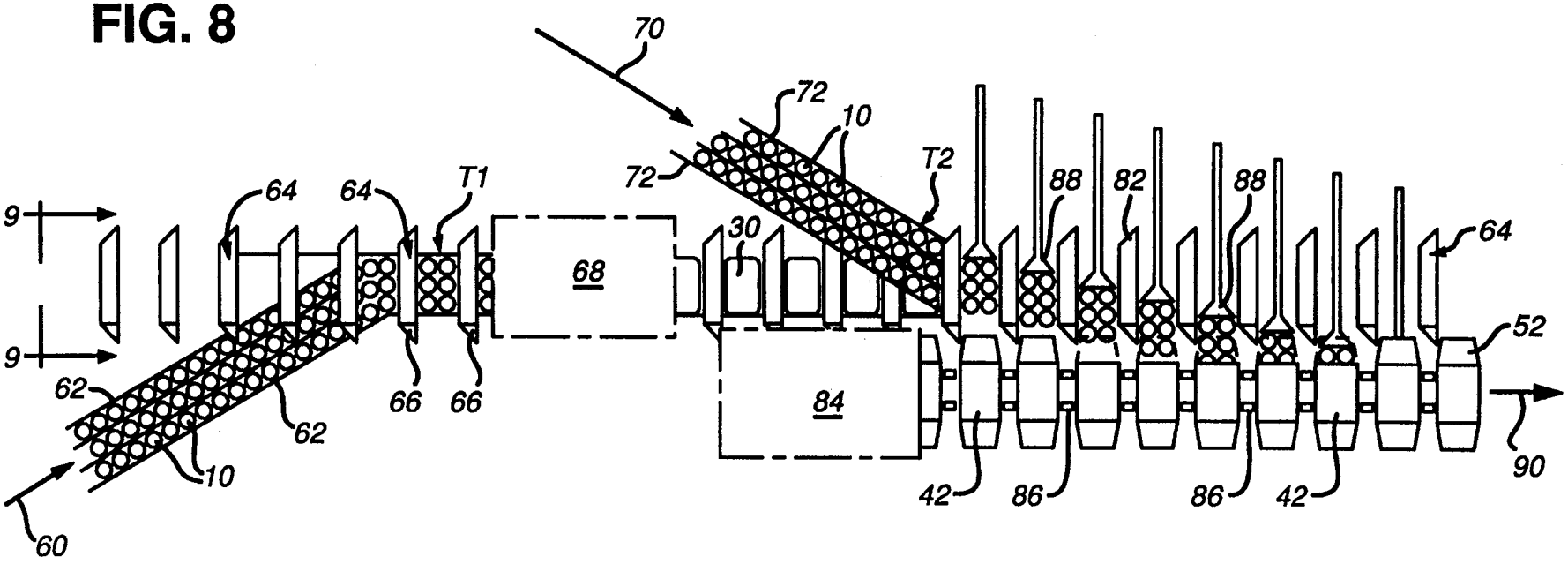
FIG. 8 is a schematic view of a packaging machine for carrying out the method.

A packaging machine which may be used for loading cartons in accordance with the method described herein can be seen schematically in FIG. 8. Cans 10 for forming the first tier enter the machine along a conveyor in the direction generally indicated by arrow 60. The cans are directed by stationary guides 62 into the path of a series of moving flight bars 64. The flight bars 64 are provided with wedge-shaped outer ends 66 which enter the incoming stream of cans 60 and divide the cans into groups, properly metering them for formation of the first tier. The operation of such flight bars is known and can be seen by reference to U.S. Pat. No. 4,237,673.

The assembled tier of cans T1 passes beneath a conventional feeder 68 which is used to remove a divider panel 30 from a hopper and place it onto the tops of the cans of the first tier T1. Any appropriate feeding device may be used, with one example being shown in U.S. Pat. No. 5,019,029, wherein the divider panel is engaged by suction cups for movement. The first tier T1 and the insert panel then move forward as a group along the path of flight bars 64.

Figure 9:
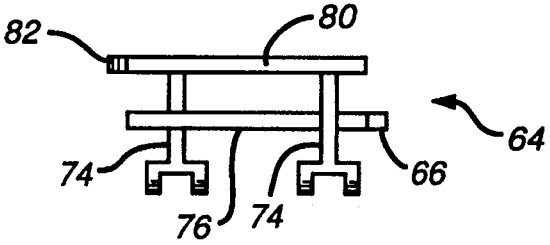
FIG. 9 is an elevational view of a flight bar which may be used with the machine of FIG. 8, taken along line 9—9 in FIG. 8.

Meanwhile, cans 10 to form the second tier of cans are directed into the machine as indicated generally by arrow 70. The cans are directed by stationary guides 72 at an upper level into the path of flight bars 64. As can be seen in FIG. 9, flight bars 64 are two-tier flight bars, having a pair of upright posts 74 being adapted at their lower ends for connection to a suitable drive chain (not shown). The lower metering bar 76 includes a wedge-shaped outer end 66 positioned at one end for dividing the cans of the lower tier, while an upper metering bar 80 includes its wedge-shaped portion 82 at the opposite end thereof, so as to separate the incoming cans for the upper tier.

Referring back to FIG. 8, the metered cans forming the second tier T2 are further directed by guides 72 into position by sliding movement along the surface of the divider panel 30, as has been herein described.

A carton feeder 84, which may be constructed according to conventional design as shown in the above-referenced U.S. Pat. No. 5,019,029, removes a folded carton 42 from a hopper (not shown) and erects the same and places it into position between a series of lugs 86 located on a pair of drive chains (not shown). Lugs 86 define a carton conveyor for moving the cartons along the machine, and such construction is well known in the art.

A series of pusher plates 88 are mounted for movement along a cam guided path to push the assembled cans and divider panel into the open end of each carton 42. The construction and operation of the pusher plates 88 is known in the art and can be seen by reference to U.S. Pat. No. 4,936,077. A pusher plate 88 engages each of the assemblies of cans and directs it into the open end of one carton 42, whereupon the cans are properly positioned within the carton.

The cartons are then advanced along the movement path 90 of the machine by lugs 86 or other appropriate means to conventional, known folding and gluing equipment (not shown).

It should be recognized that other forms of machinery can be used to slide the cans of the upper tier into position across the insert panel. For example, a second set of pusher plates could be used to push the cans of the second tier into position as a group. Alternately, the pusher plates 88 shown in FIG. 8 could be adapted to move first the cans of the second tier into position, and then the entire two-tier arrangement of cans into the carton.

What is claimed is:

1. A method of forming a package of beverage cans, each of said cans having a can body defining a substantially circular bottom therefor having a bottom diameter, and a substantially circular can lid having a top diameter, said bottom diameter being less than said top diameter, the method comprising the steps of:

forming a predetermined number of said cans into a rectangular array to define a first tier of said cans;

placing an insert panel onto said first tier, said insert panel having an area generally equal to the cross-sectional area of said rectangular array, said panel having formed therein said predetermined number of substantially circular debossments, each of said debossments having a debossment diameter not greater than said top diameter and not less than said bottom diameter and arranged on said insert panel so that one of said debossments is positioned to extend downwardly toward and concentrically on top of each of said cans of said lower tier;

placing onto said insert panel a second tier of said predetermined number of said cans, said cans of said second tier being placed onto said insert panel by sliding movement of each of said cans along said insert panel until said can is positioned with said bottom seated within one of said debossments, whereby said second tier is axially aligned with said first tier; and sliding said first tier of said cans, said insert panel and said second tier of said cans together as a unit into a carton having interconnected top, bottom and side walls, whereby said bottoms of said cans of said first tier are slid across said bottom wall of said carton into position.

2. A method as defined in claim 1, wherein said unit is slid into position within said carton through an open end defined by said top, bottom and side walls.

3. A method as defined in claim 2, wherein said carton is further provided with a plurality of end flaps connected to at least some of said top, bottom and side walls at said open end, and comprising the further steps of folding said end flaps to close said open end, and securing said end flaps in folded position.

4. A method as defined in claim 1, wherein said cans of said second tier are placed onto said insert panel by forming an incoming stream of said cans, and directing the cans of said stream to said insert panel by at least one stationary guide member.

5. A method as defined in claim 4, wherein said stream of said cans is advanced toward said insert panel at least in part by a plurality of flight bars moving along a flight bar path, said flight bars contacting said cans to impart a pushing force thereto.

6. A method as defined in claim 1, wherein each of said debossments is formed into said insert panel by debossing into said insert panel a single, circular debossment sidewall disposed out of the plane of said insert panel.

7. A method as defined in claim 1, wherein each of said debossments is formed into said insert panel by debossing into said insert panel a plurality of circular, concentric debossment sidewalls disposed out of the plane of said insert panel.

* * * * *